11/25/86 XR 4,625,204

United States Patent [19]

Clerc

[11] Patent Number: 4,625,204

[45] Date of Patent: Nov. 25, 1986

[54] SEQUENTIAL CONTROL PROCESS FOR A MATRIX DISPLAY

[75] Inventor: Jean F. Clerc, Meylan, France

[73] Assignee: Commissariat a l'Energie Atomique, Paris, France

[21] Appl. No.: 575,791

[22] Filed: Feb. 1, 1984

[30] Foreign Application Priority Data

Feb. 24, 1983 [FR] France ..... 83 03047

[51] Int. Cl.[4] ..... G09G 3/36

[52] U.S. Cl. ..... 340/784; 340/765; 340/805; 350/333

[58] Field of Search ..... 340/765, 783, 784, 785, 340/786, 805; 350/333

[56] References Cited

U.S. PATENT DOCUMENTS

| | | | |
|---|---|---|---|
| 4,041,481 | 8/1977 | Sato . | |
| 4,109,241 | 8/1978 | Shanks | 340/784 |
| 4,317,115 | 2/1982 | Kawakami et al. | 340/805 |
| 4,380,008 | 4/1983 | Kawakami et al. | 340/784 |

FOREIGN PATENT DOCUMENTS 2004679 8/1978 United Kingdom .

OTHER PUBLICATIONS

IEEE Journal of Solid State Circuits, vol. SC-13, No. 1, Feb. 1978.

*Primary Examiner*—Gerald L. Brigance
*Assistant Examiner*—Jeffery A. Brier
*Attorney, Agent, or Firm*—Oblon, Fisher, Spivak, McClelland & Maier

[57] ABSTRACT

The invention relates to a sequential control process for a matrix display using the cholesteric - nematic phase transition effect of a liquid crystal. This process consists of sequentially applying to the columns of electrodes of the display, a blanking signal followed by an addressing signal, the rows of electrodes of said display being addressed in parallel, in order to obtain the displayed or undisplayed state of the liquid crystal, followed by the sequential application of an addressing signal to the rows of electrodes, the columns of electrodes being addressed in parallel, in order to maintain the displayed or undisplayed state of the liquid crystal, while significantly improving the contrast.

9 Claims, 10 Drawing Figures

FIG.1
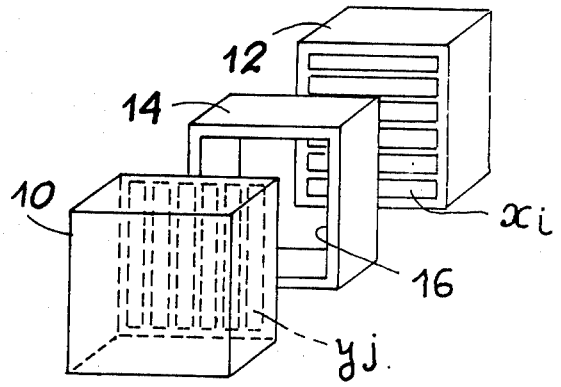
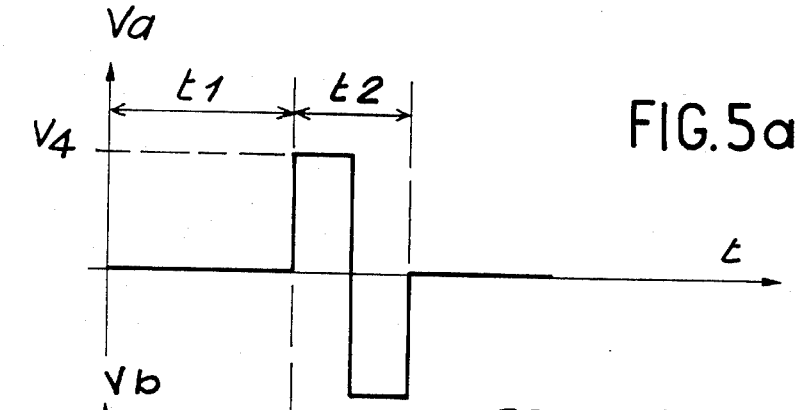
FIG.5a
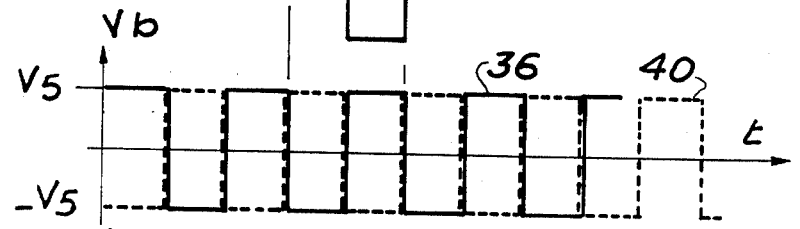
FIG.5b
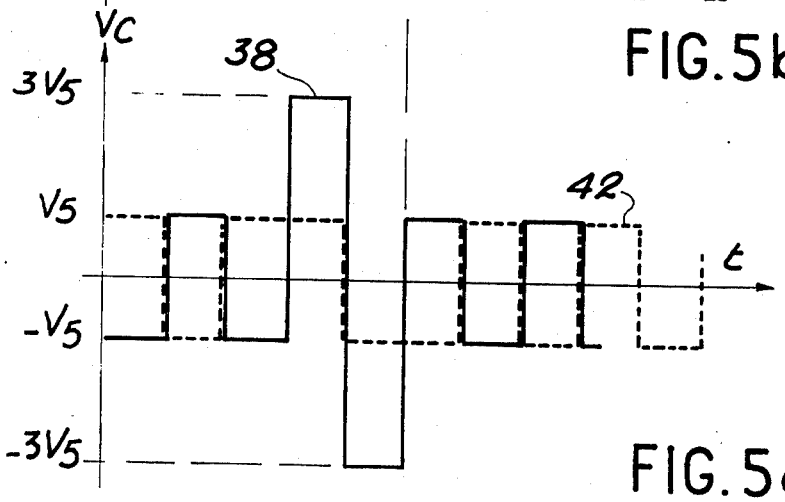
FIG.5c

FIG. 2a
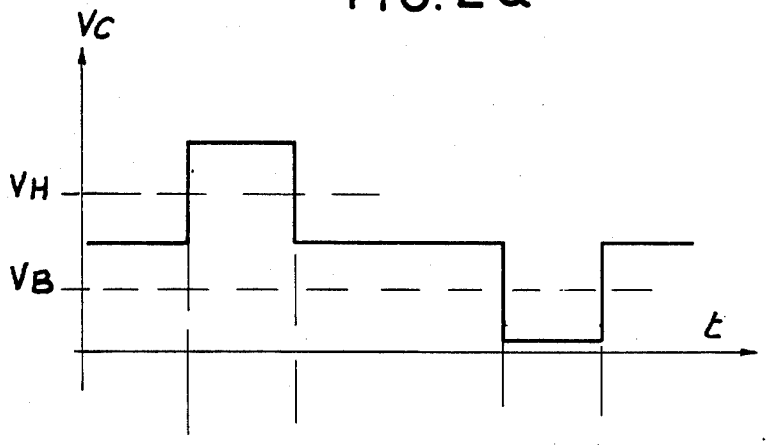
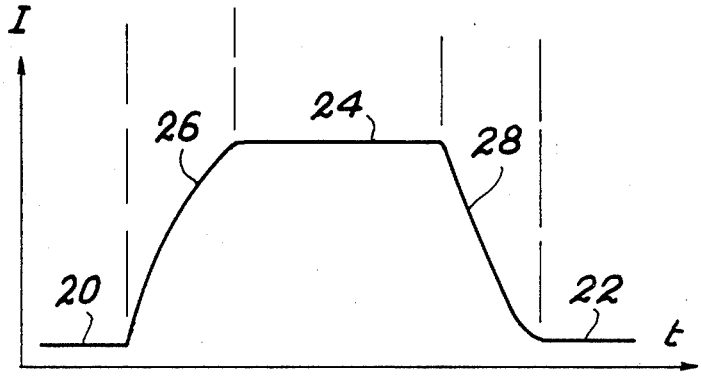
FIG. 2b

Va
t1
t2
Vo
Vo
t
29
31

Vb
Vo
-Vo
t

Vb
Vo
-Vo
t

I
30
32
(o)
34a
34
(p)
t
t1
t2

SEQUENTIAL CONTROL PROCESS FOR A MATRIX DISPLAY

BACKGROUND OF THE INVENTION

The present invention relates to a sequential control process for a matrix display using the cholesteric-nematic phase transition effect of a liquid crystal. It is used in the construction of liquid crystal displays, which are more particularly employed in the binary display of complex images or in the display of alphanumeric characters.

More specifically, the invention relates to the control of a matrix display incorporating a display cell constituted by two transparent insulating walls and by a liquid crystal having matrix-distributed areas and inserted in a cross-bar system.

FIG. 1 shows such a matrix display, which comprises a display cell having two generally transparent walls 10 and 12, arranged on either side of an insulating material shim 14, defining a volume 16 which is occupied, when the cell is fitted, by a liquid crystal film. Two systems of electrodes, each constituted by a series of semitransparent, conductive, parallel strips are dposited on walls 10 and 12. The rows of electrodes e.g. having a number p are designated $x_i$, in which i is an integer which can assume all values between 1 and p, and the columns of electrodes, e.g. having a number q which are designated $y_j$, in which j is an integer, can assume all values between 1 and q.

Thus, the useful surface of the liquid crystal is broken down into a mosaic of areas corresponding to the overlap areas of two systems of electrodes, each area corresponding to the overlap of two strips $x_i$ and $y_j$ and which therefore can be designated $x_iy_j$. The rows and columns of electrodes can carry electric signals suitable for exciting the liquid crystal, which has an optical property dependent on said excitation.

In the invention, the sensitization of an area of the liquid crystal takes place by applying to electrodes $x_i$ and $y_j$ electrical voltages, which lead to the appearance of an electric field within the liquid crystal. This electric field makes it possible to act on the cholesteric-nematic phase transition of the liquid crystal. The successive sensitization of the areas, in accordance with the known sequential control principles, makes it possible to make an image or picture appear on the complete cell by defining it point by point.

The operation of such a display will briefly be described. The liquid crystal has two threshold voltages, a low threshold voltage $V_B$ and a high threshold voltage $V_H$, such that $0<V_B<V_H$. The applcation of a potential difference between the rows $x_i$ and the columns $y_j$, or control voltage, which exceeds the high threshold voltage $V_H$, makes it possible to obtain the liquid crystal in nematic form and the application of a potential difference between the rows $x_i$ and the columns $y_j$ which is lower than the low threshold voltage $V_B$ makes it possible to obtain the liquid crystal in cholesteric form, no matter what the preceding phase of the liquid crystal. The obtaining of a nematic phase for an area $x_iy_j$ of the liquid crystal corresponds to the display of this area, which becomes white in the presence of a dichroic dye, and the obtaining of a cholesteric phase for said same area corresponds to the undisplayed state of said area, which then appears black due to the dichroism of the dye.

In addition, this type of display cell has a certain memory effect. Thus, after obtaining the displayed state of area $x_iy_j$, the application of a potential difference between row $x_i$ and column $y_j$ between voltages $V_B$ and $V_H$ is sufficient to maintain the displayed state of said area. In the same way, after obtaining the undisplayed state of area $x_iy_j$, the application of a potential difference between row $x_i$ and column $y_j$ (between voltages $V_B$ and $V_H$) is sufficient to maintain the undisplayed state of this area. It should be noted that these maintaining voltages of the displayed or undisplayed states are necessary for maintaining a good contrast between the displayed areas or white points and the undisplayed areas or black points. The absence of these maintaining voltages leads to a significant reduction in this contrast.

FIG. 2*a* shows the potential difference between row $x_i$ and column $y_j$, or control voltage $V_C$, as a function of time, whilst in FIG. 2*b*, it is possible to see the response curve of the liquid crystal as a function of the value of the potential difference $V_C$, and response curve corresponding to the light intensity (I) transmitted by area $x_iy_j$ as a function of time. The level portions 20 and 22 of the response curve of the cell correspond to the undisplayed state of area $x_iy_j$, whilst level portion 24 of the same curve corresponds to the display state of this area. The rising and falling portions respectively 26, 28 of said curve correspond to the cholesteric-nematic phase change and the nematic-cholesteric change of the liquid crystal respectively and consequently to the passage from the undisplayed state to the displayed state and vice versa.

At present, several control processes for a liquid crystal matrix display are known, which make use of the transition effect of the cholesteric-nematic phase of said crystal.

In one of the known processes, the sensitization of area $x_iy_j$ of the liquid crystal, i.e. the obtaining of one of the states, i.e. displayed or undisplayed, is brought about by the transmission on line $x_i$ for a time $t_1$ equal to $r\tau$, in which r is an integer and $\tau$ is an elementary time interval useful for control purposes, an electric blanking signal having an amplitude well above the high threshold voltage $V_H$ of the liquid crystal followed by an electric addressing signal of said row, for a time $t_2$ equal to $\tau$. The integer r is dependent on the transition speed between the two phases of the liquid crystal used. Its value is a few units, generally 1, 2 or 3. Time $\tau$ corresponds to the minimum time necessary for the nematic-cholesteric phase change of the liquid crystal (passage from the nematic phase of the cholesteric phase). These electric signals are generally alternating signals with a mean zero value.

FIG. 3 shows as a function of time, a control signal of row $x_i$, Va corresponding to the effective voltage of said signal. Part 29 of the signal corresponds to the blanking signal and part 31 thereof to the row addressing signal.

Moreover, to column $y_j$ is applied an electric addressing signal, particularly an alternating signal with a mean zero value having an effective value which is generally equal to that of the addressing signal of row $x_i$, said signal being either in phase or in phase opposition with the addressing signal of row $x_i$ during the addressing time $t_2$ thereof. FIGS. 3*b* and 3*c* show as a function of time, the addressing signal of column $y_j$, respectively in phase and in phase opposition with the addressing signal of row $x_i$, $V_B$ corresponding to the effective voltage of said signals.

When the signals applied to row $x_i$ (FIG. 3a) and column $y_j$ are in phase (FIG. 3b), these signals having equal amplitudes, the potential difference $V_c$ at the terminals of the liquid crystal in then zero, i.e. lower than the low threshold value $V_B$ of said crystal ($V_B<0$). In this case, the undisplayed state of area $x_iy_j$ is obtained. In the same way, when the signals applied to row $x_i$ (FIG. 3a) and column $y_j$ (FIG. 3c) are in phase opposition, the voltage $V_c$ at the terminals of the liquid crystal is then equal to $2V_O$, if $V_O$ represents the effective value of said signals. Value $V_O$ is chosen in such a way that the voltage $2V_O$ at the terminals of the liquid crystal exceeds the high threshold voltage $V_H$ of the crystal, which makes it possible to obtain the displayed state of area $x_iy_j$.

In accordance with the sequential control of a matrix display, the p rows are successively controlled and the q columns are simultaneously controlled in order to bring about the appearance on the display of an image, or an alphanumeric character, defined point by point.

In an article by KARL-HEINZ WALTER and MIROSLAV KARL TAUER, which appeared in the IEEE Journal of Solid-State Circuits, Vol. SC-13, No. 1, February 1978, entitled "Pulse-Length Modulation Achieves Two-Phase Writing in Matrix Addressed Liquid-Crystal Information Displays", a control process of this type was described.

FIG. 4 shows the response curves of area $x_iy_j$ of the liquid crystal as a function of the preceding sensitizations. These curves give the light intensity (I) transmitted by the liquid crystal area as a function of time. The rising part 30 of the two curves O and P corresponds to the cholesteric-nematic phase change of the liquid crystal (passage from the cholesteric phase to the nematic phase), said phase change taking place during the blanking cycle $t_1$. It should be noted that the time for obtaining this phase transition is relatively long, so that it must be carried out during the blanking cycle $t_l$ of row $x_i$. The level portion 32 of curve O corresponds to the displayed state of area $x_iy_j$ obtained when the signals applied to row $x_i$ and column $y_j$ are in phase opposition, whilst level portion 34 of curve P corresponds to the undisplayed state of area $x_iy_j$ obtained when signals are applied in phase to row $x_i$ and column $y_j$. The falling portion 34a of curve P corresponds to the nematic-cholesteric phase change of the liquid crystal.

In such a control process, during the blanking time $t_i$, the q areas of row $x_i$ are in the displayed state, in view of the fact that the q columns of electrodes are simultaneously controlled. Thus, a white line appears over the entire length of the display. During the sequential addressing of all the rows, i.e. the addressing of the rows one after the other, a while line passes from top to bottom of the display. This white line, which appears whenever it is wished to modify the state of area $x_iy_j$ is very unpleasant for the person looking at the display, particularly with respect to the areas thereof which it is wished to maintain in one of these states, namely displayed or undisplayed.

SUMMARY OF THE INVENTION

The present invention relates to a sequential control process for a matrix display using the cholesteric-nematic phase transition effect of a liquid crystal, which more particularly makes it possible to prevent the passage of such a while line over the display.

The present invention more specifically relates to a process for the sequential control of a matrix display using the cholesteric-nematic phase transition effect of a liquid crystal incorporating areas distributed in matrix-like manner and introduced between a first group of p rows of parallel electrodes and a second group of q columns of parallel electrodes, the said rows and said columns intersecting one another, an area $x_iy_j$ being defined by the region of the liquid crystal covered by row $x_i$, in which i is an integer such that $1 \leqq i \leqq p$, and by the column $y_j$, in which j is an integer such that $1 \leqq j \leqq q$, the rows and columns being used for carrying electrical signals acting on the phase transition of the liquid crystal, one of the two phases corresponding to the displayed state and the other to the undisplayed state, the liquid crystal having a low threshold voltage $V_B$ and a high threshold voltage $V_H$, wherein in order to obtain one of the two states of area $x_iy_j$, for a time $t_1$ equal to $s\tau$, in which $\tau$ is a time interval useful for control purposes and s is an integer, to column $y_j$ is applied a first potential $V_1$ having a value higher than the high threshold value $V_H$, followed by a second potential $V_2$ applied to said column during time $t_2$ equal to $\tau$, the other columns receiving a zero potential, whilst to row $x_i$ is applied a third potential $V_3$, the potentials $V_2$ and $V_3$ having during time $t_2$, phases and values such that the sum $V_2+V_3$ exceeds the high threshold voltage $V_H$ in order to obtain the displayed state and the difference $V_2-V_3$ is lower than the low threshold voltage $V_B$ for obtaining the undisplayed state, and for maintaining the state of area $x_iy_j$, during time $t_1$ a zero potential is applied to row $x_i$, whilst a fourth potential $V_4$ is applied during time $t_2$, the other rows receiving a zero potential, and a fifth potential $V_5$ is applied to column $y_j$, the potentials $V_4$ and $V_5$ having during time $t_2$ phases and values such that the sum $V_4+V_5$ exceeds the low threshold voltage $V_B$ for maintaining the displayed state and the difference $V_4-V_5$ is lower than the hither threshold voltage $V_H$ for maintaining the undisplayed state.

Potentials $V_4$ and $V_5$ satisfy the equation $V_4=2V_5$ to ensure that there is no modification to the appearance of area $x_iy_j$ during the addressing of the row over time $\tau_1$.

Compared with the prior art control processes, the sensitization of an area $x_iy_j$, i.e. the obtaining of a displayed state or an undisplayed state of said area, takes place by reversing the function of the rows and columns of electrodes, which makes it possible on sensitizing the p areas of the liquid crystal of the same column $y_j$, by simultaneously applying potential $V_3$ to the p rows of electrodes, to eliminate the passage of the white line over the display.

According to a preferred embodiment of the invention, sum $V_4+V_5$ exceeds the high threshold voltage $V_H$ in order to freshen up the displayed state during the scanning of the row.

The use of such potential values $V_4$ and $V_5$ makes it possible to improve the contrast between the liquid crystal areas in the displayed state and the areas in the undisplayed state, i.e. to improve the contrast between the white points and the black points of the display.

According to a preferred embodiment of the process according to the invention, potentials $V_2$ and $V_3$ are equal.

According to another preferred embodiment of the process according to the invention, the various potentials $V_1$, $V_2$, $V_3$, $V_4$ and $V_5$ are alternating potentials with zero mean values, which then represent the effective values of said potentials.

BRIEF DESCRIPTION OF THE DRAWINGS

The invention is described in greater detail hereinafter relative to non-limitative embodiments and the attached drawings, wherein show:

FIG. 1, already described, an exploded perspective view of a liquid crystal cell using cross-bar electrodes.

FIGS. 2*a* and 2*b*, already described, the operating principle of a display using the cholestericnematic transition of a liquid crystal; FIG. 2 representing the voltage $V_C$ applied to the terminals of an area $x_iy_j$ of the liquid crystal as a function of time (t) and FIG. 2*b* the response curve of said area on excitation, the curve representing the light intensity (I) transmitted by said areas as a function of time (t).

FIGS. 5*a* and 5*b*, as a function of time, the configuration of the control signals applied to row $x_i$ and to column $y_j$ of a matrix display, in order to maintain the displayed state or the undisplayed state of the corresponding area $x_iy_j$.

FIG. 5*c* the potential difference applied to the terminals of area $x_iy_j$, relative to the control signals of FIGS. 5*a* and 5*b*.

DETAILED DESCRIPTION OF THE PREFERRED EMBODIMENTS

Figures 3A, 3B, 3C, 4:
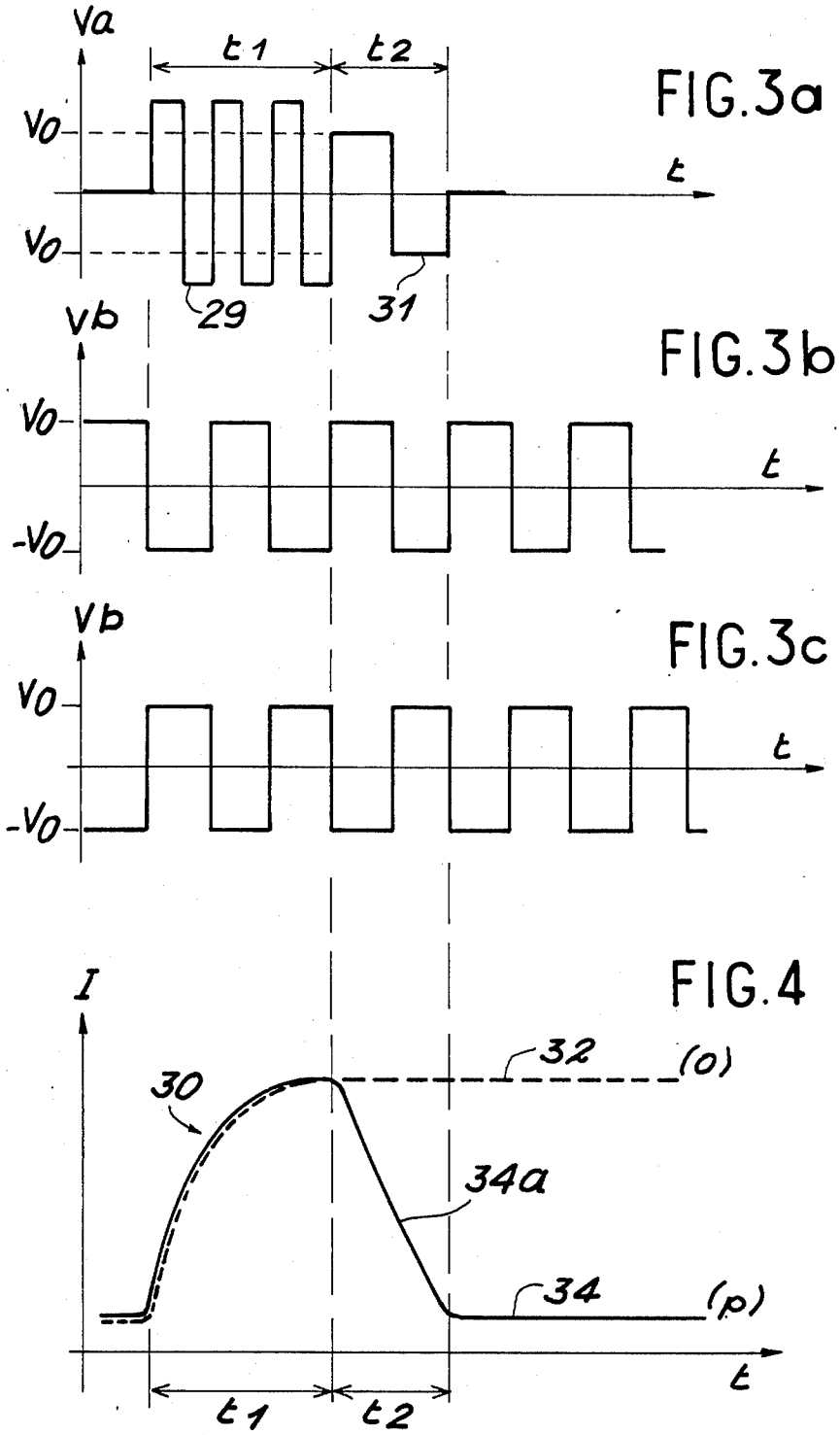
FIGS. 3*a*, 3*b*, 3*c*, already described, as a function of time, the configuration of the control signals applied to row $x_i$ and to column $y_j$ of a matrix display, in order to obtain the displayed state or the undisplayed state of the corresponding area $x_iy_j$.
FIG. 4, already described, the response curve of liquid crystal area $x_iy_j$, relating to the excitation signals of FIGS. 3*a* to 3*c*.

In order to obtain one of the two states, displayed or undisplayed, of a liquid crystal area $x_iy_j$, according to the invention a first potential $V_1$ having a voltage well above the high threshold voltage $V_H$ of the liquid crystal is applied to column $y_j$ (FIG. 1). This first potential corresponds to the blanking signal relative to area $x_iy_j$. As in the prior art, this blanking signal is applied prior to the actual addressing of area $x_iy_j$, in order to permit passage from the cholesteric phase to the nematic phase of the liquid crystal. This signal is applied for a time $t_1$ equal to $s\tau$, s being an integer dependent on the transition speed between these two phases of the liquid crystal used and $\tau$ being the minimum time necessary for the passage from the nematic phase to the cholesteric phase.

Preferably, this blanking signal is an alternating signal with a zero mean value, e.g. a square-wave signal, for which $V_1$ represents the effective value of the signal. This signal is more particularly that shown in part 29 of the signal in FIG. 3*a*.

Following said blanking signal, a second potential $V_2$ corresponding to the addressing signal of column $y_j$ is applied to the latter. This addressing signal is applied for a time $t_2$ equal to $\tau$.

This addressing signal of column $y_j$ is preferably an alternating signal with a zero mean value, e.g. a square-wave signal, for which $V_2$ represents the effective value of the signal. This signal is more particularly that shown in part 31 of the signal of FIG. 3*a*.

Moreover, a third potential $V_3$ corresponding to the addressing signal of row $x_i$ is applied thereto (FIG. 1). This signal is preferably an alternating signal with a zero mean value, e.g. a square-wave signal, for which $V_3$ represents the effective value of the signal. This signal is particularly that shown in FIGS. 3*b* or 3*c*.

According to the invention, the sum of the potentials $V_2+V_3$ at the terminals of the liquid crystal, or the control voltage during the addressing time $t_2$ of column $y_j$, must have a value exceeding the high threshold voltage $V_H$ of the liquid crystal in order to obtain the displayed state of area $x_iy_j$, or in other words, a white point on the display. In the same way, the potential difference $V_2-V_3$ during time $t_2$ must have a value below the low threshold voltage $V_B$ of the liquid crystal in order to obtain the displayed state of area $x_iy_j$, or in other words, a black point on the display. Preferably the two potentials $V_2$ and $V_3$ are equal.

When the addressing signals of column $y_j$ (FIG. 3*a*) and row $x_i$ (FIGS. 3*b*–3*c*) are alternating signals with a zero mean value, a displayed state (white point) is also obtained by using, during time $t_2$, signals in phase opposition, like those shown in FIGS. 3*a* and 3*c*. For potentials $V_2$ and $V_3$, equal to value $V_O$, a sum of the potentials $V_2+V_3$ equal to $2V_O$ is obtained. Value $V_O$ must be chosen in such a way that voltage $2V_O$ exceeds the high threshold voltage $V_H$ of the liquid crystal. Value $V_O$ is a function of the liquid crystal used in the matrix display.

In the same way, the obtaining of the undisplayed state (black point) takes place by using, for time $t_2$, in phase row and column signals, like those shown in FIGS. 3*a* and 3*b*. For potentials $V_2$ and $V_3$ equal to value $V_O$, a potential difference $V_2-V_3$ equal to 0 is obtained. In view of the fact that the low threshold voltage $V_B$ of the liquid crystal exceeds O, we obtain value $V_2-V_3$ which is lower than $V_B$. Moreover, the unselected columns of the display are raised to a zero continuous potential, e.g. earth potential.

In accordance with the sequential addressing of a matrix display, the columns are successively controlled, whilst the rows are simultaneously controlled. Moreover, the display or non-display of a complete column of the display takes place by sensitizing, in the manner described hereinbefore, the p areas of said column by simultaneously applying potential $V_3$ to each row.

As stated hereinbefore, liquid crystals having a cholesteric-nematic phase transition have a memory effect, i.e. after eliminating the electric control signal, the displayed or white points of the display remain displayed. The same applies with respect to the undisplayed or black points. However, the contrast of these points reduces over a period of time, so that it is necessary to maintain a certain voltage at the terminals of the corresponding area $x_iy_j$ in order to prevent an excessive contrast loss.

In order to maintain the state of area $x_iy_j$ according to the invention, for time $t_1$ a zero potential is applied to row $x_i$, i.e. without a blanking signal and then during time $t_2$ a fourth potential $V_4$ is applied, which corresponds to the row addressing signal. Moreover, a fifth potential $V_5$ corresponding to the column addressing signal is applied to column $y_j$.

Preferably, the row and column addressing signals are alternating signals with a zero mean value, i.e. square-wave signals, for which $V_4$ and $V_5$ respectively represent the effective values of said signals. FIG. 5*a* shows the addressing signal of row $x_i$, as a function of time, $V_a$ corresponding to the effective voltage of said row signal. FIG. 5*b* shows the addressing signal of column $y_j$, as a function of time, $V_b$ corresponding to the effective voltage of the column signal.

According to the invention, the sum of the potentials $V_4+V_5$ at the terminals of the liquid crystal during addressing time $t_2$ must have a value exceeding the low threshold voltage $V_B$ of the liquid crystal in order to maintain the displayed state of area $x_iy_j$ (white point). In the same way, the potential difference $V_4-V_5$ during time $t_2$ must have a value lower than high threshold voltage $V_H$ of the liquid crystal in order to maintain the undisplayed state of the area $x_iy_j$ (black point).

Preferably, the sum of the potentials $V_4+V_5$, for maintaining the displayed state, exceeds the high theshold voltage $V_H$ of the liquid crystal. This makes it possible to improve the contrast between the areas in the displayed state (white points) and the areas in the undisplayed state (black points). Moreover, potential $V_4$ is chosen so as to be equal to twice potential $V_5$ in order to prevent any modification of the appearance during the scanning of the row.

When the signals for maintaining row $x_i$ (FIG. 5*a*) and column $y_j$ (FIG. 5*b*) are alternating signals with a zero mean value, the maintaining of the displayed state (white point) takes place by using, for time $t_2$, signals in phase opposition, like the signal of FIG. 5*a* and the unbroken line signal 36 in FIG. 5*b*. For a potential $V_5$ equal to $V_O$, we obtain a sum of the potentials $V_4+V_5$ or the control voltage $V_c$, equal to $3V_O$ which, in view of the choice of $V_O$ for a given liquid crystal, is a voltage above the high threshold voltage $V_H$ of said crystal.

FIG. 5*c* shows the voltage $V_c$ applied to the liquid crystal terminals, the unbroken line signal 38 being obtained when the row and column signals are in phase opposition.

In the same way, the maintaining of the undisplayed state (black point) takes place by using in phase row and column signals during time $t_2$, in the same way as the signal of FIG. 5*a* and the broken line signal 40 of FIG. 5*b*. For a potential $V_5$ equal to $V_O$, we obtain a potential difference $V_4-V_5$, or control voltage $V_c$, equal to $V_O$, $V_O$ being chosen lower than the high threshold voltage $V_H$ of the liquid crystal.

The broken line signal 42 of FIG. 5*c* represents the voltage $V_c$ applied to the liquid crystal terminals, when the row and column signals are in phase.

In accordance with the sequential addressing of a matrix display, the rows are successively controlled. Moreover, the maintenance of the displayed or undisplayed state of a complete row of the matrix display, i.e. the q areas of said row, takes place by simultaneously applying the potential $V_5$ to each column. The threshold voltage values are approximately a few volts. Typically, the low threshold voltage $V_B$ is 5 V and the high threshold voltage $V_H$ 10 V.

The liquid crystals used, which have a cholesteric - nematic phase transition, are constituted by a mixture of three components, namely a nematic component, a cholesteric component and a dye. Among the nematic components used, reference can be made to those belonging to the group of bipheny 1s, such as components E7 and E43 of the MERCK company, esters, Schiff's bases and phenylcyclohexanes. The cholesteric component can be a mixture of CB15 produced by the B.d.h. company and ZL811 produced by the MERCK company in proportion such that there is little variation with the temperature. Finally, anthraquinones such as components D5 and D16 of the B.d.h. company are dyes which are widely used in the art.

What is claimed is:

1. A sequential control process of a matrix display using the cholesteric-nematic phase transition effect of a liquid crystal interposed between a first group of p rows of parallel electrodes and a second group of q columns of parallel electrodes, said rows and said columns intersecting one another, an area $x_iy_j$ of said liquid crystal being defined by a region of said liquid crystal covered by row $x_i$, in which i is an integer such that $1 \leqq i \leqq p$, and by the column $y_j$, in which j is an integer such that $1 \leqq j \leqq q$, said rows and columns being used for carrying electrical signals acting on said phase transition, one of said two phases corresponding to the displayed state and the other to the undisplayed state, said liquid crystal having a low threshold voltage $V_B$ which is a maximum voltage for obtaining the cholesteric form, and a high threshold voltage $V_H$ which is a minimum voltage for obtaining the nematic form with $0<V_B<V_H$, wherein:

(A) in order to obtain one of the two states of area $x_iy_j$, the process comprises, (1) applying a first potential $V_1$ to column $y_j$ for a time $t_1$ equal to $s\tau$, in which $\tau$ is a time interval useful for control purposes and s is an integer, said first potential $V_1$, having a value higher than the high threshold voltage $V_H$, (2) applying just after step (1), a second potential $V_2$ to said column $y_j$ for time $t_2$ equal to $\tau$, the other columns receiving a zero potential, (3) applying a third potential $V_3$ to row $x_i$, said potentials $V_2$ and $V_3$ having during time $t_2$, phases and values such that the sum $V_2+V_3$ exceeds the high threshold voltage $V_H$ for obtaining the displayed state and the difference $V_2-V_3$ is lower than the low threshold voltage $V_B$ for obtaining the undisplayed state; and alternatively (B) in order to maintain one of the two states, of area $x_iy_j$, the process comprises, (1) applying a zero potential to row $x_i$ during time $t_1$, (2) applying just after step (4), a fourth potential $V_4$ to said row $x_i$ during time $t_2$, the other rows receiving a zero potential, (3) applying a fifth potential $V_5$ to column $y_j$, said potentials $V_4$ and have $V_5$ having during time $t_2$ phases and values such that the sum $V_4+V_5$ exceeds the low threshold voltage $V_B$ for maintaining the displayed state and the difference $V_4-V_5$ is lower than the high threshold voltage $V_H$ for maintaining the undisplayed state.

2. A control process according to claim 1, wherein the sum $V_4+V_5$ exceeds the high threshold voltage $V_H$ in order to maintain the displayed state.

3. A control process according to claim 1, wherein the potential $V_2$ is equal to the potential $V_3$.

4. A control process according to claim 1, wherein the potential $V_4$ is equal to twice the potential $V_5$.

5. A control process according to claim 1, wherein the different potentials $V_1$, $V_2$, $V_3$, $V_4$ and $V_5$ are alternating potentials with zero mean values.

6. A control process according to claim 5, wherein the potentials are square-wave potentials.

7. A control process according to claim 1, wherein the potentials $V_3$ is applied to several of the p rows of electrodes in order to obtain one of the two states of the p areas of the same column $y_j$.

8. A control process according to claim 1, wherein the potential $V_5$ is simultaneously applied to the q columns of electrodes in order to maintain the state of the q areas of the same row $x_i$.

9. A control process according to claim 7, wherein the potential $V_5$ is simultaneously applied to the q columns of electrodes in order to maintain the state of the q areas of the same row $x_i$.

* * * * *